US005108091A

United States Patent [19]

Chang

[11] Patent Number: 5,108,091

[45] Date of Patent: Apr. 28, 1992

[54] MULTI-PURPOSE CONTROLLER FOR A STATIONARY BICYCLE

[76] Inventor: John Chang, P.O. Box 82-144, Taipei, Taiwan R.O.C.

[21] Appl. No.: 751,082

[22] Filed: Aug. 28, 1991

[51] Int. Cl.[5] ..... A63B 69/16; A63B 21/00

[52] U.S. Cl. ..... 482/64; 482/909

[58] Field of Search ..... 272/73, 71, 72, DIG. 5, 272/DIG. 6, 131, 129; 73/379, 432

[56] References Cited

U.S. PATENT DOCUMENTS 4,364,557 12/1982 Serati ..... 272/73

4,630,818 12/1986 Saarinen ..... 272/73

5,029,846 7/1991 Hao ..... 272/DIG. 5

*Primary Examiner*—Stephen R. Crow

*Attorney, Agent, or Firm*—Alfred Lei

[57] ABSTRACT

This invention relates to a multi-purpose controller for a stationary bicycle and in particular to one mounted on the lateral side of a rotating disc and having two wires connected with a display and an adjusting knob whereby the controller may provide a function of automatic periodic adjustment mode or a manual adjustment mode as desired as to adapt to the need of various users.

1 Claim, 8 Drawing Sheets

MULTI-PURPOSE CONTROLLER FOR A STATIONARY BICYCLE

BACKGROUND OF THE INVENTION

With reference to FIG. 1, there is shown a perspective view of a prior art stationary bicycle. As illustrated, the stationary bicycle is driven by pedals 11 which in turn drives a rotating disc 12. On the rotating disc 12 there is an adjustable braking belt 13 with its top end fixed by a movable fastener 14 and its bottom passing into the support 15. The tightness of the adjustable braking belt 13 is controlled by an adjusting rod 16 on the support 155. The rotating disc 12 is provided at one side with a mechanical meter or an electronic sensor 18 for showing the quantity of energy comsumption in a display 19. All stationary bicycles on the market have the same structure except the meter which may be a mechanical one or a liquid crystal display. However, all such stationary bicycles have the following drawbacks:

1. In order to adapt to users of different ages, it is necessary to adjust the tightness of the braking belt 13 to control the friction to the rotating disc 12. Nevertheless, the tightness of the braking belt 13 is very difficult to be accurately adjusted thereby decreasing the function of the stationary bicycle.

2. It is necessary for the user to stop his two hands in order to adjust the tightness of the braking belt 13, hence making it inconvenient to use.

3. The braking belt 13 and the connector 18 of the display 18 are separately mounted on the circumference and lateral side of the rotating disc 12 and so it is time-consuming for the installation.

SUMMARY OF THE INVENTION

This invention relates to a multi-purpose controller for a stationary bicycle.

It is the primary object of the present invention to provide a multi-purpose controller which has a function of automatic periodic adjustment tightness.

It is another object of the present invention to provide a multi-purpose controller which also has a function of manual adjustment tightness.

It is still another object of the present invention to provide a multi-purpose controller which is easy to assemble.

It is still another object of the present invention to provide a multi-purpose controller which may use an electronic liquid crystal display.

It is a further object of the present invention to provide a multi-purpose controller which is simple in construction.

Other objects and merits and a fuller understanding of the present invention will be obtained by those having ordinary skill in the art when the following detailed description is read in conjunction with the accompanying drawings.

DETAILED DESCRIPTION OF THE PREFERRED EMBODIMENT

Figure 1:
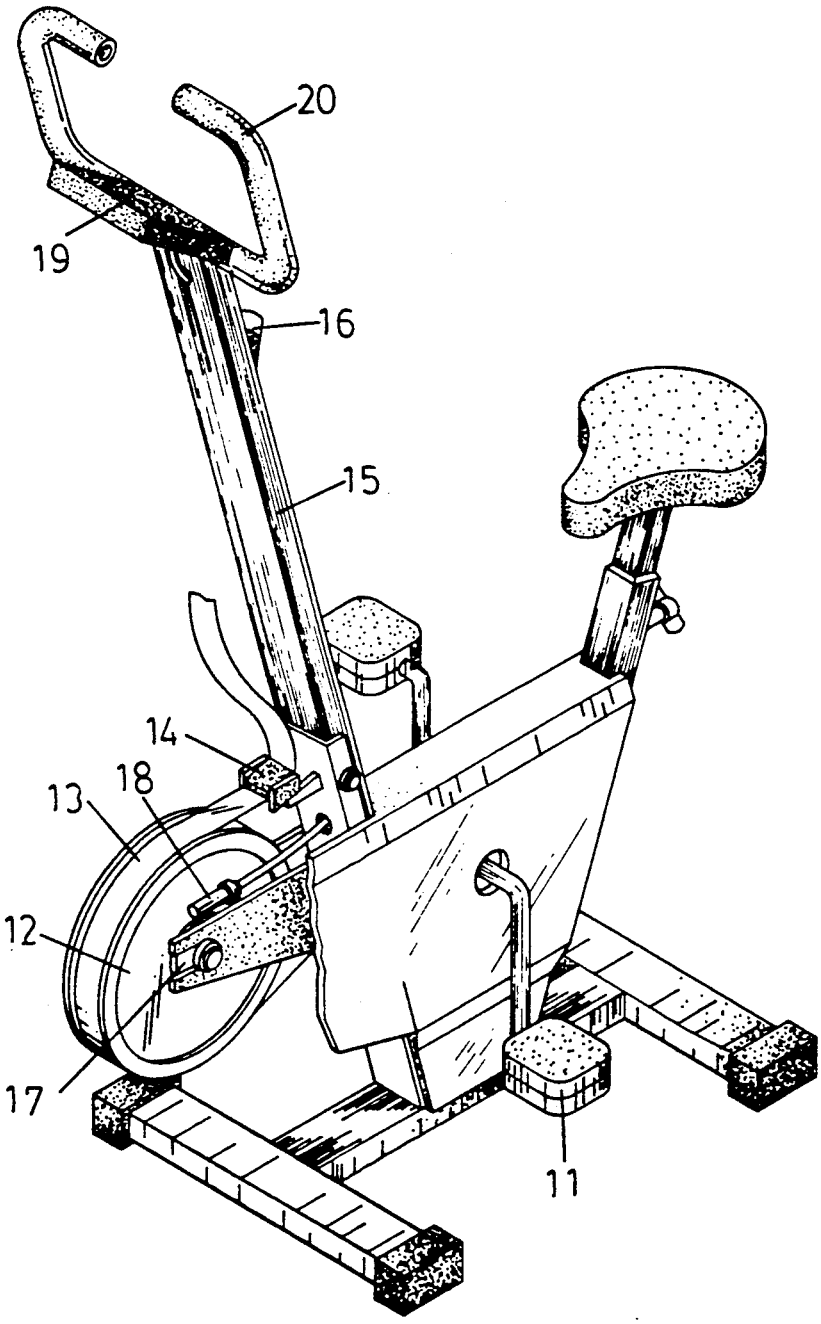
PRIOR ART FIG. 1
FIG. 1 is a perspective view of a prior art stationary bicycle.
Figure 2:
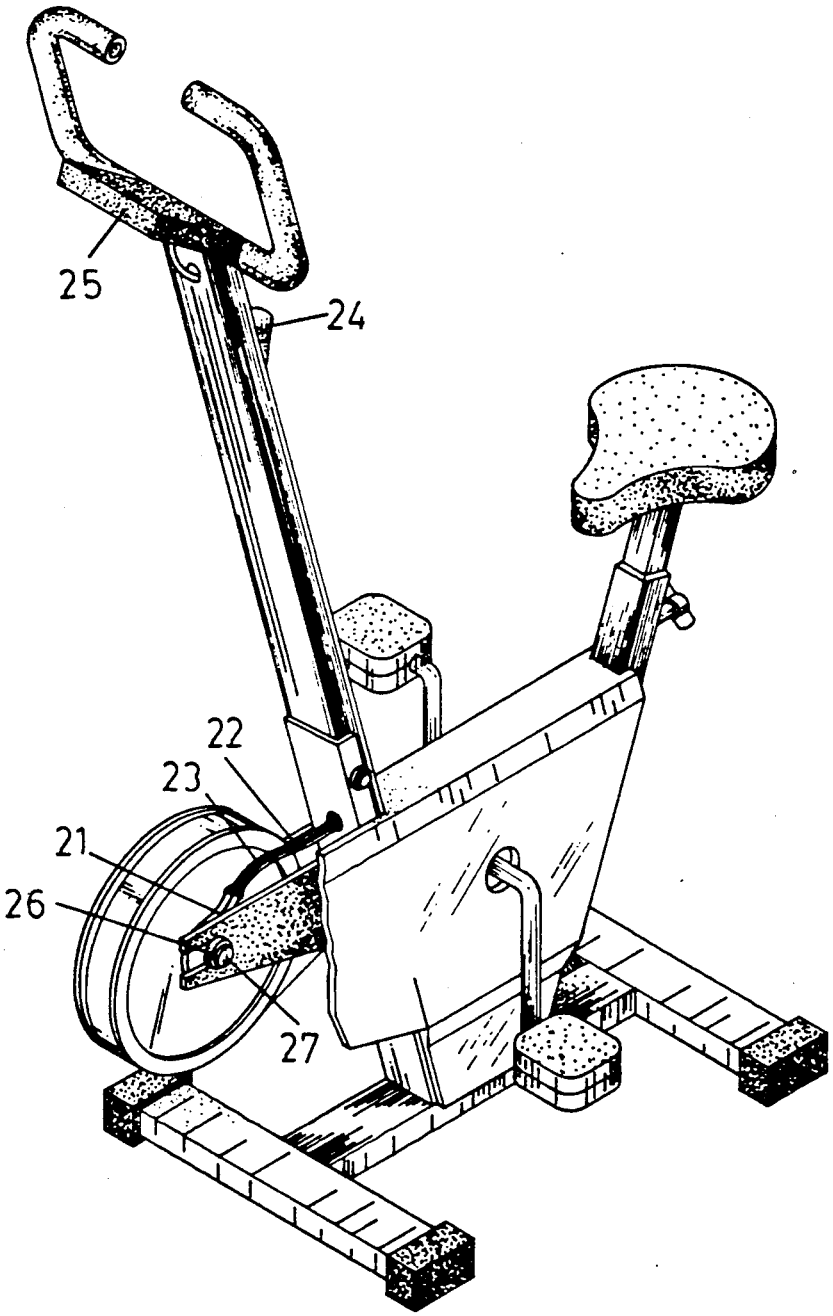
FIG. 2 is a perspective view of a stationary bicycle equipped with a multi-purpose controller according to the present invention.

With reference to the drawings and in particular to FIG. 2 thereof, the multi-purpose controller 21 according to the present invention comprises a circular member with two wires 22 and 23 of which one is connected to an adjustable knob 24 and the other to a display 25. The circular member is mounted on one side of a rotating disc and locked onto a fixed axle 27 by a screw 26.

Figure 3:
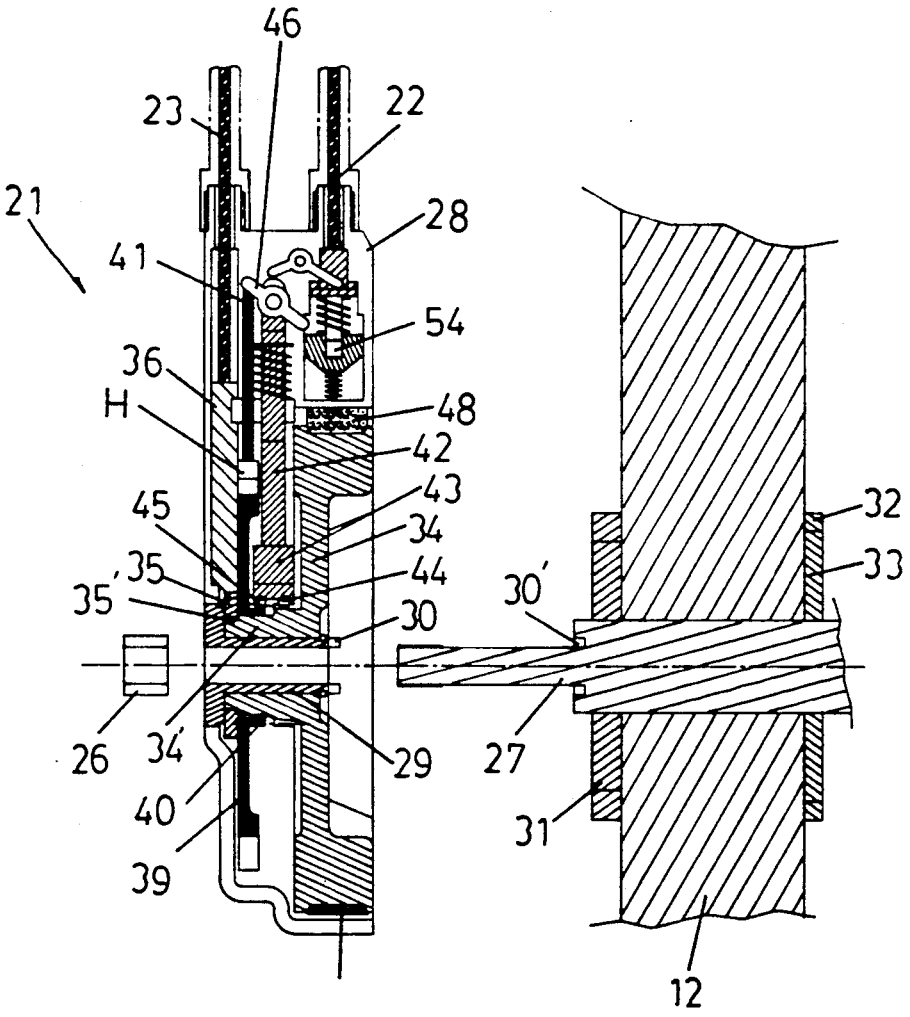
FIG. 3 is a sectional view of the multi-purpose controller according to the present invention.

FIG. 3 is a sectional view of the controller 21. As illustrated, the controller 21 mainly comprises a housing 28 and a sleeve 29 fixedly connected with the housing 28. The sleeve 29 has a projection 30 engaged with a recess 30' of the fixed axle 27 and the controller 21 is then locked on one side of the rotating disc 12 by the screw 26. Hence, the sleeve 29 and the housing 28 are fixedly connected with the fixed axle 27 and cannot be rotated. The rotating disc 12 is rotated by pedals 11 via a chain 32 and a gear 33. A rotating plate 34 is engaged with the sleeve 27 so that it will rotate in unison with the gear 31 of the rotating disc 12. As the rotating plate 34 turns, a bevel gear 35 fixedly connected with the rotating plate 34 by a pin 35' will be driven. When the rotating disc 12 turns around the rotating plate 34 and the bevel gear 35 will be driven to turn around. In the meantime, a worm 36 engaged with the bevel gear 35 will also be rotated thereby driving the display 25 via a wire 23 and therefore showing the quantity fo total energy consumption. If the bevel gear 35 is replaced with a magnetic plate, then the worm 36 is changed to a sensor to form a liquid crystal display 25. Hence, the present invention may use a mechanical meter or an electronic liquid crystal display.

Figure 4:
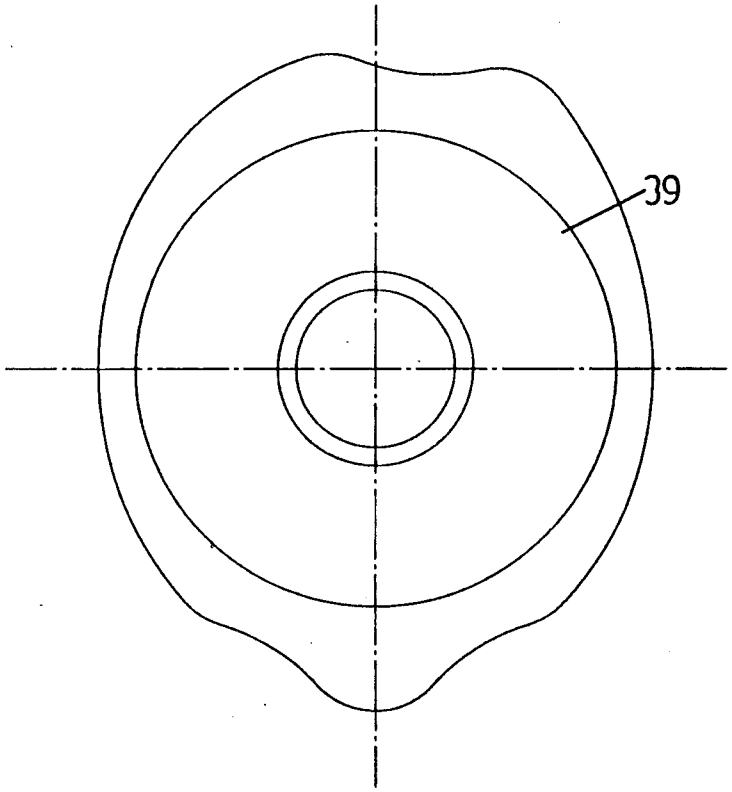
FIG. 4 is a front view of the control panel of the multi-purpose controller.
Figure 5:
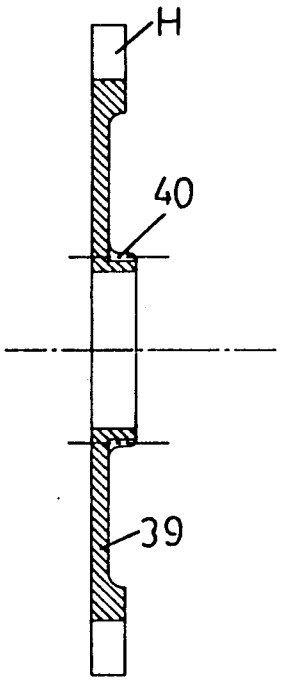
FIG. 5 is a sectional side view of FIG. 4.
Figure 6:
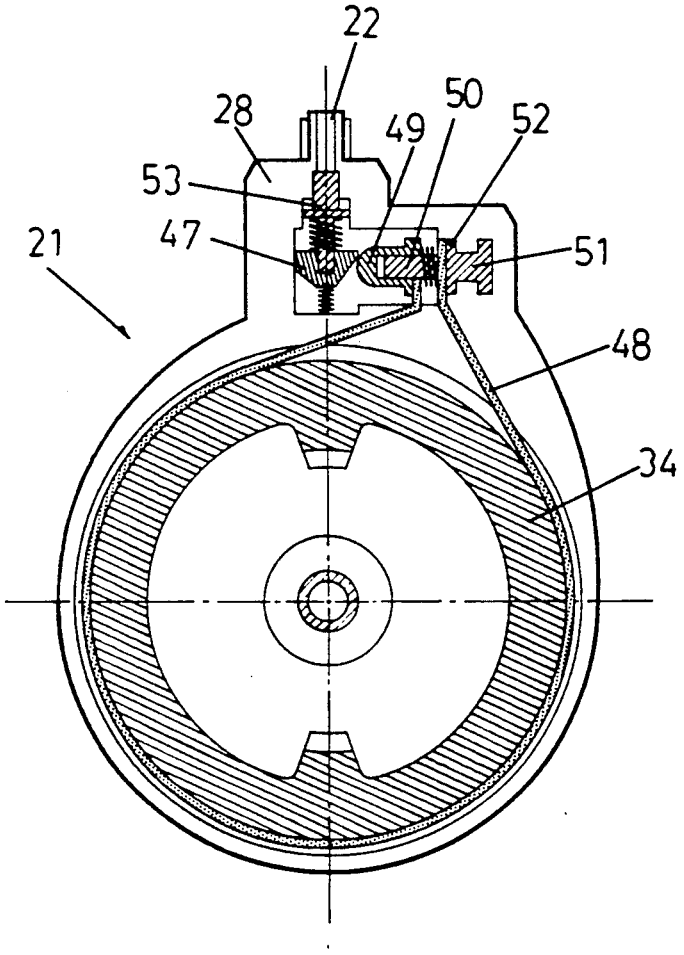
FIG. 6 is a sectional view of the multi-purpose controller.

The rotating plate 34 is provided at the rear side with a bevel gear 38. A control panel 39 fits over a rear flange 34' of the rotating plate 34. The inner side of the rotating plate 34 is formed into a gear shaped member 40. The structure and shape of the control panel 39 are shown in FIG. 4. As illustrated, the control panel 39 is of an irregular shape and has an actuating rod 41. Between the rotating plate 34 and the control panel 39 there is an elevating rod 42. The lower end of the elevating rod 42 is provided with a reduction gear set 43. When the rotating plate 34 turns, the gear 44 of the reduction gear set 43 is driven and a pinion 45 drives the gear 40 of the control panel 39 thereby slowly rotating the control panel 39. When the control panel 39 rotates slowly, the actuating rod thereon will move up and down and drive a rotatable adjusting member 46 of the elevating rod 42 to move through an angle. Then, the adjusting member 46 urges an adjusting block 47 to move up and down. In the meantime, the vertical displacement of the adjusting block 47 will vary with the height of the control panel 39. When the curved portion of the control panel 39 is located at the highest point H, the actuating rod 41 will move to its highest point. Meanwhile, the adjusting block 47 is located at the lowest point and the braking belt 48. The relative motion between the rotating plate and the adjusting block 47 is shown in FIG. 5. The adjusting block 47 has an inclined surface so that when it is moved up and down, a U-shaped sleeve 49 will be driven to move sidewards. The U-shaped sleeve 49 is fitted over an axle 50 which is connected at one end with the housing 28 by a threaded member 51. The braking belt 48 is connected with the threaded member 51 at one end and with the U-shaped sleeve 49 at the other. Between the U-shaped sleeve 49 and the threaded member 51 there is a spring 52 which will urge the U-shaped sleeve 49 to go rightward when the adjusting block 47 is moved downward thereby tightening the braking belt 48.

Figure 7:
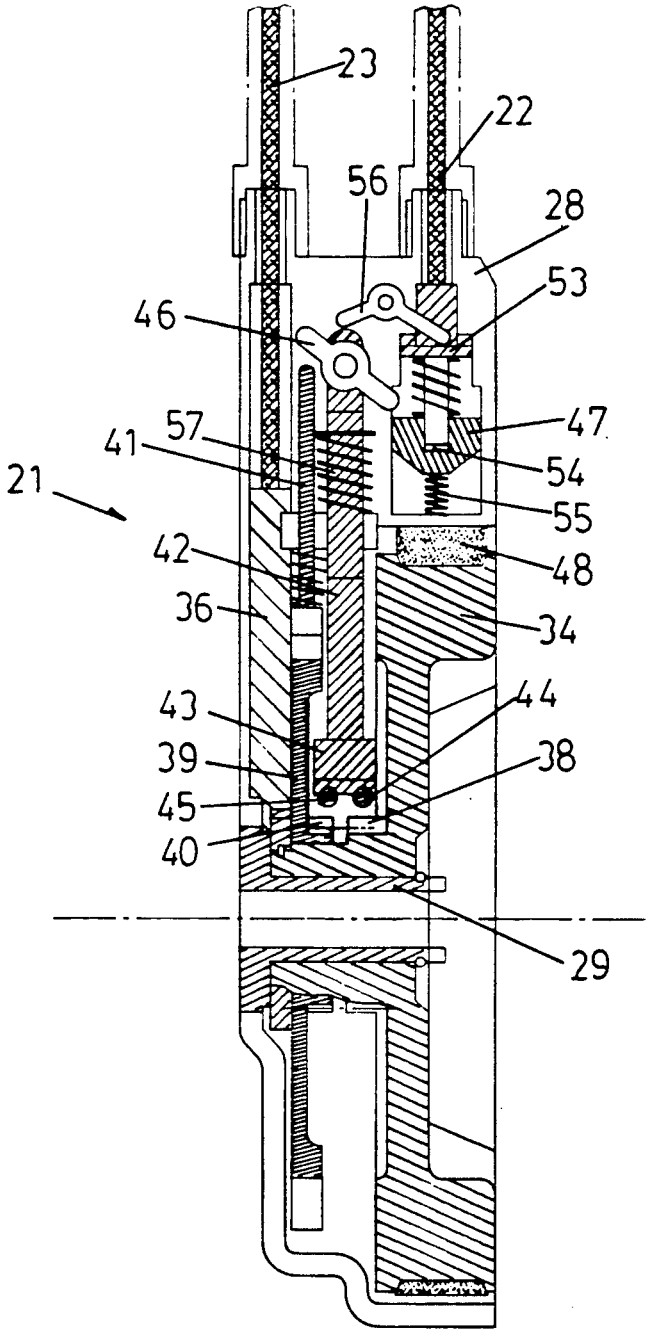
FIG. 7 shows the principle of the present invention.

As shown in FIG. 7, when the adjusting knob 24 is manually regulated, the wire 22 will go downward and the adjusting bolt 53 will bear against the bottom of the recess 54 of the adjusting block 47 hence forcing the adjusting block 47 to go downwards. When the adjusting bolt 53 is further regulated to go downward, the braking belt 48 will be further tightened. As the adjusting bolt 53 is regulated back to go upwards, the adjusting block 47 will be moved upwards by the spring 55 on the bottom and the braking belt 53 will be released. Then the braking belt 53 is completely controlled by the adjusting knob 24. When the adjusting bolt 53 is moved downwards, an adjusting plate 56 with the housing 28 as a fulcrum will move upwards at the right side but downwards at the left side. Thus, the elevating member 42 will be moved upwards by the spring 57 so that the gear set in the bottom will be separated from the rotating plate 34, the bevel gear 38 of the control panel and the gear 40. Accordingly, the control panel 39 is stationary and there is no automatic periodical adjustment in tightness and the tightness is completely controlled by manual power. When the adjusting knob 53 returns to its original position, the adjusting plate 56 will turn leftward thereby urging the elevating rod 42 to go downwards and engaging the reduction gear set 43 with the rotating plate 34 and the panel 39 again and therefore, returning to the automatic periodical adjustment. Hence, the manual control type and the automatic periodic adjustment may be used as desired without influencing the rotation of the bevel gear 35. Conclusively, the present invention is an adjusting device with three functions.

Figure 8:
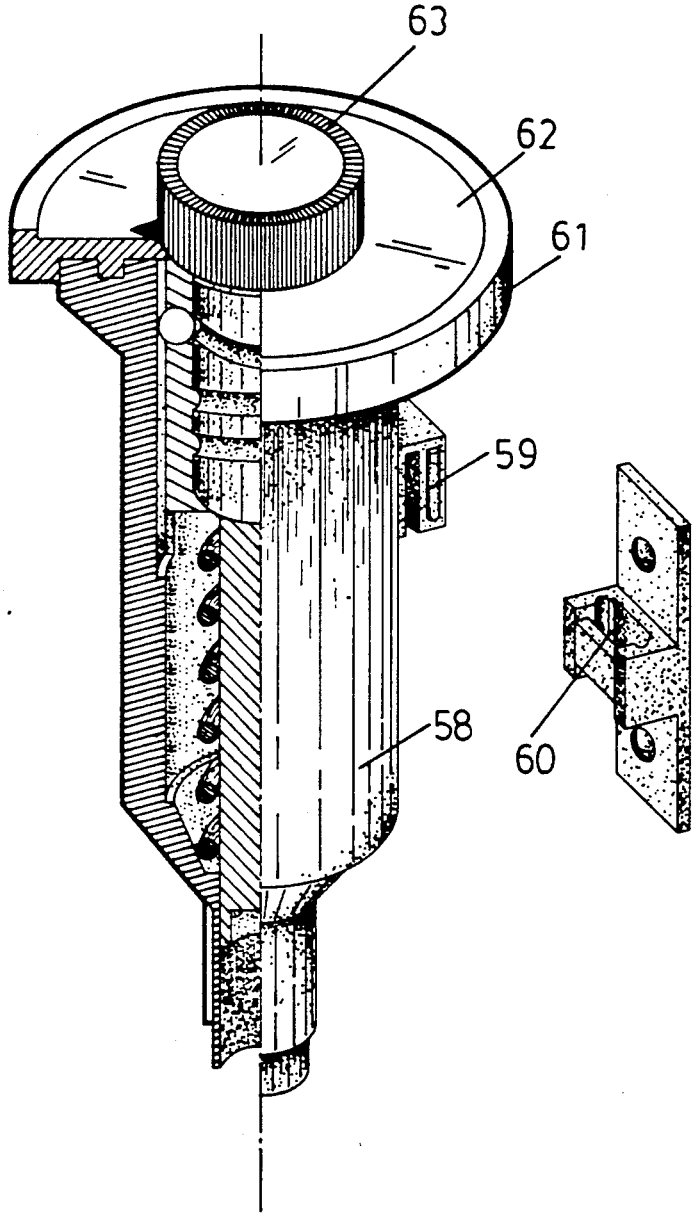
FIG. 8 shows the structure of the adjustable knob.
Figure 12:
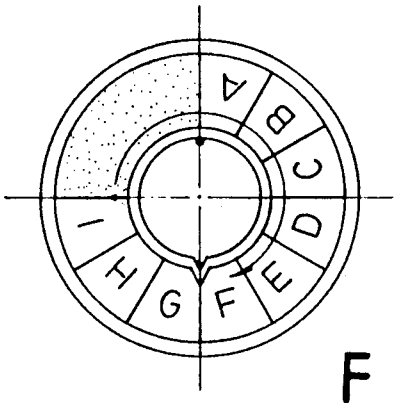
FIG. 12 is a top view of FIG. 10.
Figure 10:
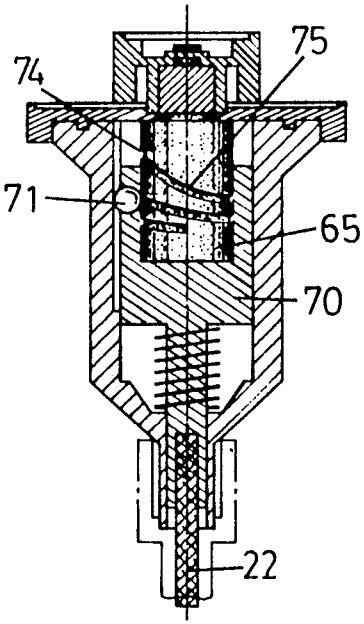
FIGS. 9 - 10 show the principle of the adjustable knob.
Figure 11:
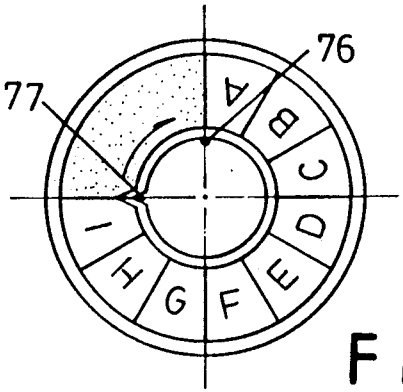
FIG. 11 is a top view of FIG. 9.
Figure 9:
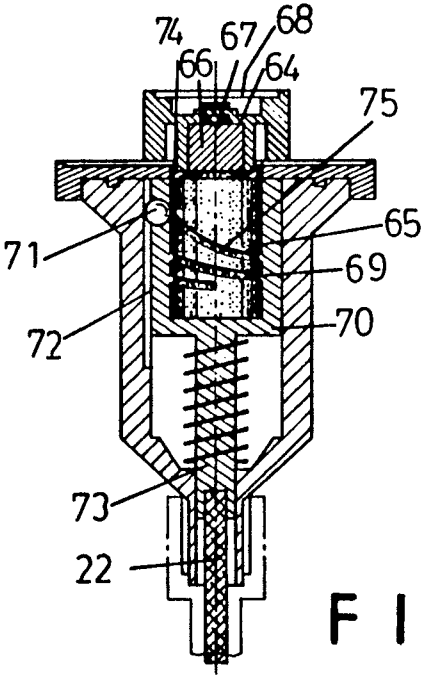

FIG. 8 shows the structure of the adjusting knob 7. As illustrated, the body 58 of the adjusting knob 7 is provided with a hook 59 for engaging with the slot 60 of the support (not shown) of a stationary bicycle. On the body 58 there is a cover 61 with a calibrated plate 62. A knob 63 is mounted on the cablibrated plate. As may be seen in FIGS. 9-12, the knob 63 has a square recess 64 which is engaged with a square member 66 on the top of a rotating rod 65. By means of the rotating rod 65, the protuberance 67 of the square member 66 first extends through the square recess 64 and then is fixed on the recess 64 by a C-clip 67. Finally, a cap plate 68 is covered thereon. The outer flange of the rotating rod 65 is formed with a spiral groove 69 and engaged with a sleeve 70 which has a hole for receiving a steel ball 71. The steel ball 71 protrudes out of the sleeve 70 on both sides, with its one side engaged with the recess 69 of the rotating rod 65 and its the other side with the groove 72 of the body 58. Below the sleeve 70 is a rod 73 engaged with a wire 22 of the controller 21. Most part of the groove 69 of the rotating rod 65 is a regular spiral. The front part of the groove 69 has a larger inclination than the remaining part thereof. The position changes from the highest point 74 to the lowest point 75 as the knob 63 turns an angle of 90 degrees. As the knob 63 turns an angle of 90 degrees, the steel ball 71 will be moved downwards thus moving the sleeve 70 downwards. Then the sleeve 70 urges the adjusting bolt 53 in the controller 21 to go downwards, thus changing the adjusting device 21 from the automatic periodic adjustment mode to the manual adjustment mode. The purpose of 90 degree position is designed to prevent the rotating rod 65 from rotating reversely and change back to the automatic periodic adjustment mode. Beyond 90 degree position, when the knob 63 is further rotated, the steel ball 71 will go downwards hence forcing the sleeve 70 to go downwards too. In other words, when the wire 22 is further moved downwards, the adjusting bolt 53 will force the adjusting block 54 to go further downwards. At that time, the braking belt 48 is further tightened. This manual adjustment may be adjusted as desired. Further, the manual adjustment mode may be changed to the automatic periodic adjustment mode as desired.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A multi-purpose controller for a stationary bicycle comprising:

a housing mounted on one side of a rotating disc of said stationary bicycle and having a first wire connected to an adjusting knob and a second wire connected to a display;

a sleeve engaged with said housing and having a protuberance engaged with a recess of an axle of said stationary bicycle by a screw;

a rotating plate fitting over said sleeve and provided with a bevel gear meshed with a worm a control panel with an irregular curved shape, fitting over a rear flange of said rotating plate and an actuating rod engaged with a gear;

an elevating rod mounted between said rotating plate and said control panel and provided at the bottom with a reduction gear set on which there is an adjusting plate;

an adjusting block disposed within said housing and having a recess in which is mounted a spring, said adjusting block being moved by said spring and an adjusting bolt;

an adjusting bolt with a wire connected to an adjusting knob and being able to move upwards or downwards, said adjusting bolt being arranged above the recess of said adjusting block in which is a spring;

a braking belt with an end fixedly mounted on a threaded member attached to an axle and with the other end fixedly connected to a U-shaped sleeve which fits over said axle and is urged by the inclined surface of the adjusting block to move horizontally to adjust the tightness thereof;

an adjusting knob having a hook fixedly mounted on the recess of a support of said stationary bicycle and a cover on which there is a calibrated plate, said adjusting knob further having a turning knob with a square recess engaged with a square member of a rotating rod, the protuberance of said square member extending through said square recess and being fixed on said rotating knob by a C-clip and covered with a cap;

a rotating rod disposed in said adjusting knob and having a spiral groove and a sleeve, said sleeve being formed with a hole for receiving a steel ball extending at one side to a recess of said rotating rod, the other side of the steel ball being movable in the body, said sleeve having a rod connected with a wire of the controller;

whereby said controller may be changed from automatic periodic adjustment mode to manual adjustment mode as desired.

* * * * *